US009052150B2

(12) United States Patent
Talasco

(10) Patent No.: US 9,052,150 B2
(45) Date of Patent: Jun. 9, 2015

(54) FIREARM TRIGGER MECHANISM, FIREARM AND METHOD OF CONTROLLING A RATE OF THE FIREARM

(71) Applicant: Eric Talasco, North Granby, CT (US)

(72) Inventor: Eric Talasco, North Granby, CT (US)

(73) Assignee: COLT'S MANUFACTURING COMPANY LLC, West Hartford, CT (US)

( * ) Notice: Subject to any disclaimer, the term of this patent is extended or adjusted under 35 U.S.C. 154(b) by 153 days.

(21) Appl. No.: 13/836,458

(22) Filed: Mar. 15, 2013

(65) Prior Publication Data

US 2014/0260942 A1 Sep. 18, 2014

(51) Int. Cl.

| | |
|---|---|
| ***F41A 19/02*** | (2006.01) |
| ***F41A 19/10*** | (2006.01) |
| ***F41A 19/03*** | (2006.01) |
| ***F41A 17/32*** | (2006.01) |
| ***F41A 19/04*** | (2006.01) |
| ***F41A 19/09*** | (2006.01) |
| ***F41A 19/14*** | (2006.01) |
| ***F41A 19/43*** | (2006.01) |
| ***F41A 19/46*** | (2006.01) |

(52) U.S. Cl.

CPC ..... *F41A 19/10* (2013.01); *F41A 19/03* (2013.01); *F41A 17/32* (2013.01); *F41A 19/04* (2013.01); *F41A 19/09* (2013.01); *F41A 19/14* (2013.01); *F41A 19/43* (2013.01); *F41A 19/46* (2013.01)

(58) Field of Classification Search

CPC ..... F41A 19/31; F41A 19/33; F41A 19/46; F41A 3/26; F41A 3/66; F41A 17/74; F41A 19/30; F41A 3/38

USPC ..... 89/129.01–154

See application file for complete search history.

(56) References Cited

U.S. PATENT DOCUMENTS

| | | | | |
|---|---|---|---|---|
| 1,381,590 | A * | 6/1921 | Oliver | 89/147 |
| 1,427,097 | A * | 8/1922 | Feederle | 89/137 |
| 2,945,422 | A * | 7/1960 | Allyn | 89/154 |
| 3,045,555 | A * | 7/1962 | Stoner | 89/142 |
| 3,333,508 | A * | 8/1967 | Kruzell | 89/179 |
| 5,726,377 | A | 3/1998 | Harris et al. | |
| 5,945,626 | A | 8/1999 | Robbins | |
| 6,792,711 | B2 | 9/2004 | Battaglia | |
| 7,131,228 | B2 | 11/2006 | Hochstrate et al. | |
| 7,610,844 | B2 | 11/2009 | Kuczynko et al. | |
| 7,775,150 | B2 | 8/2010 | Hochstrate et al. | |
| 7,934,447 | B2 | 5/2011 | Kuczynko et al. | |
| 7,938,055 | B2 | 5/2011 | Hochstrate et al. | |
| 2010/0095833 | A1* | 4/2010 | Gavage et al. | 89/140 |
| 2011/0079137 | A1* | 4/2011 | Audibert et al. | 89/136 |
| 2012/0152104 | A1 | 6/2012 | Audibert et al. | |

FOREIGN PATENT DOCUMENTS

WO WO2010030987 A1 3/2010

* cited by examiner

*Primary Examiner* — Samir Abdosh
(74) *Attorney, Agent, or Firm* — Cantor Colburn LLP

(57) ABSTRACT

A trigger mechanism for a firearm, the trigger mechanism having: a trigger for actuating a hammer of the trigger mechanism, wherein actuation of the trigger causes the hammer to advance to a firing position; and a release configured for movement between a first position and a second position, the release must be first actuated from the first position to the second position and thereafter from the second position to the first position in order to allow for the hammer to advance to the firing position.

18 Claims, 10 Drawing Sheets

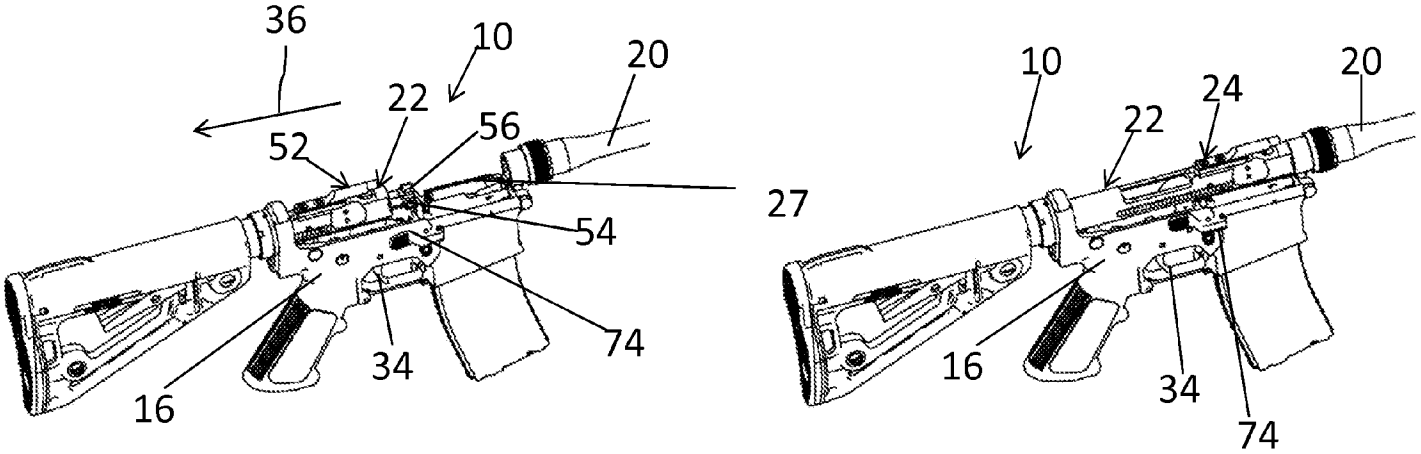
FIG. 3B
FIG. 3
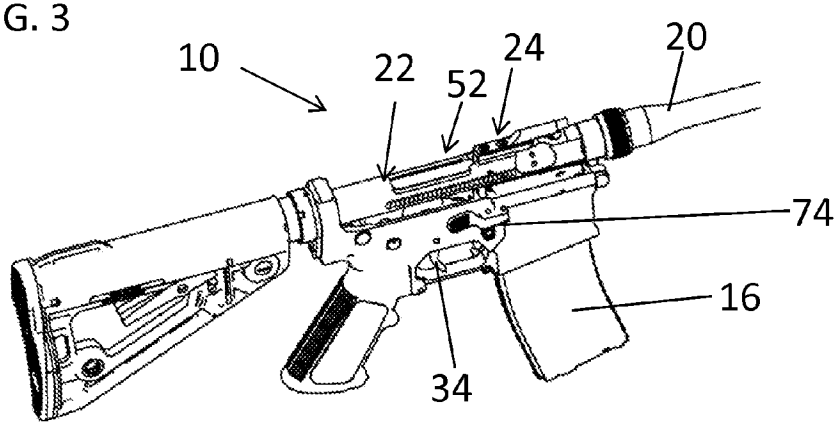
FIG. 3A 32
28
42
43
74
16

75
28
29
74
16
7E
7E 7C
28
74
16
7D
7D 7C
74
16
42
46
40
75
16
79
50
77
70

70
75
80
74
16

32
29
28
42
70
16

42
44
40
50
48
73
16
70

70
73
74
28
16

42
70
30
28
16

43
74
42
16

74
73
16

74
42
16

FIREARM TRIGGER MECHANISM, FIREARM AND METHOD OF CONTROLLING A RATE OF THE FIREARM

FIELD OF THE INVENTION

Various embodiments of the invention relate generally to firearms and more particularly, a mechanism or trigger mechanism for a firearm and a firearm having the mechanism or trigger mechanism.

BACKGROUND OF THE INVENTION

Firearms have automatic trigger mechanisms, such as the type disclosed in U.S. Pat. No. 3,045,555 to Stoner, which can operate in an automatic or semi-automatic firing mode.

It is desirable to provide a mechanism or trigger mechanism for a firearm wherein a controlled rate of fire or a single shot mode is provided.

SUMMARY OF THE INVENTION

In one embodiment, a trigger mechanism for a firearm is provided. The trigger mechanism having: a trigger for actuating a hammer of the trigger mechanism, wherein actuation of the trigger causes the hammer to advance to a firing position; and a release configured for movement between a first position and a second position, the release must be first actuated from the first position to the second position and thereafter from the second position to the first position in order to allow for the hammer to advance to the firing position.

In another embodiment, a firearm is provided, the firearm having: a barrel; a bolt carrier assembly movably received within the firearm for movement between a first position and a second position; a trigger mechanism for firing a round from the firearm, the trigger mechanism having: a trigger; a hammer pivotally mounted to the firearm for movement between a first position and a second position, wherein actuation of the trigger causes the hammer to advance from the first position to the second position, wherein the hammer contacts a firing pin of the firearm; a release configured for movement between a first position and a second position, the release must be first actuated from the first position to the second position and thereafter from the second position to the first position in order to allow for the hammer to advance to the second position after a round has been fired from the firearm.

In yet another embodiment, a method of controlling the firing rate of a firearm is provided, the method including the steps of: limiting movement of a bolt carrier assembly of the firearm to a position wherein actuation of a trigger of the firearm will not fire another round after a first round has been fired; releasing the bolt carrier assembly from the position to another position, wherein actuation of the trigger will cause a hammer to contact a firing pin of the bolt carrier assembly, wherein the releasing of the bolt carrier assembly from the position is caused by actuation of a release button located on a surface of the firearm proximate to the trigger.

Other aspects and features of embodiments will become apparent to those ordinarily skilled in the art upon review of the following description of specific embodiments of the invention in conjunction with the accompanying figures.

BRIEF DESCRIPTION OF THE DRAWINGS

Embodiments of the invention will now be described, by way of example only, with reference to the attached Figures, wherein:

FIGS. 2-3B are partial cross-sectional views of the firearm illustrating operation of various embodiments of the present invention;

DETAILED DESCRIPTION

Figure 1:
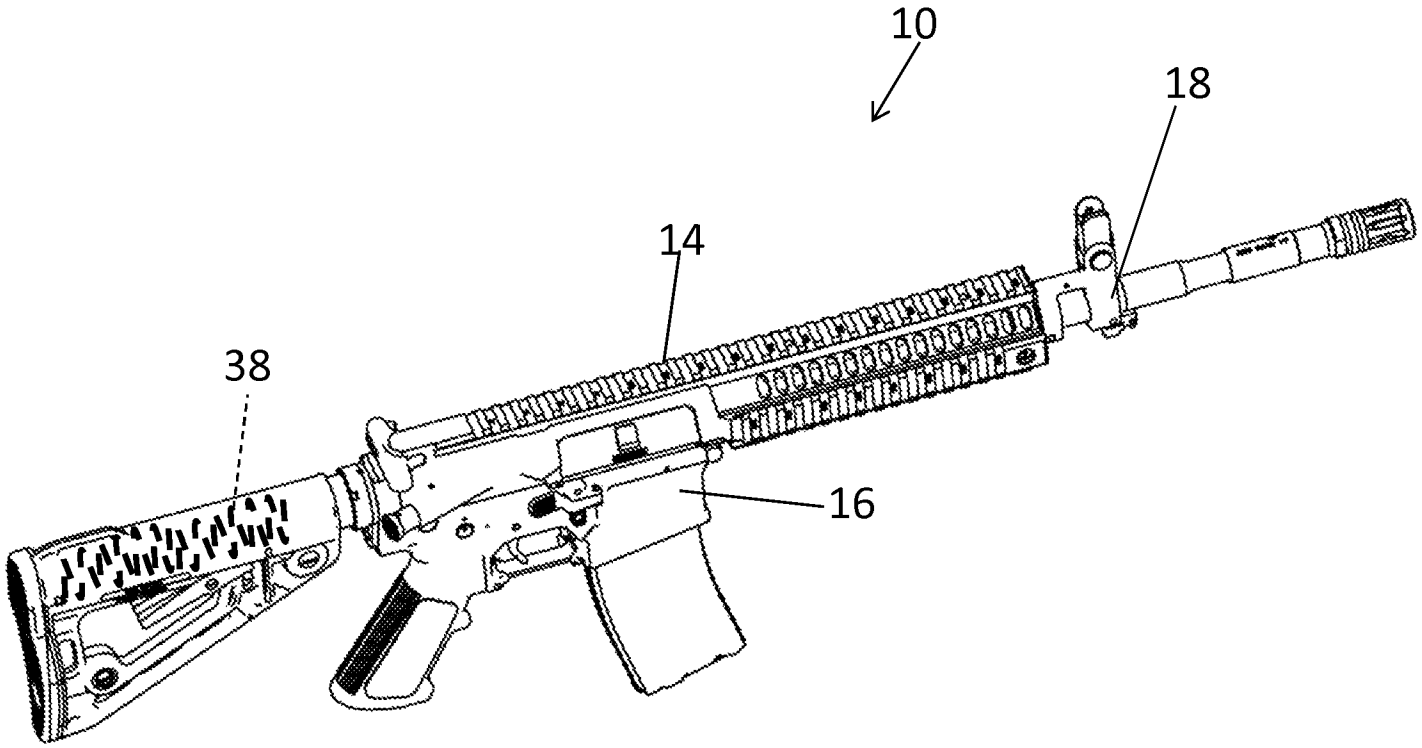
FIG. 1 is a perspective view of a portion of a firearm incorporating a trigger mechanism in accordance with an exemplary embodiment of the present invention.

Referring now to the FIGS., a firearm or rifle 10 is illustrated. In accordance with an exemplary embodiment of the present invention, the firearm or rifle 10 has a mechanism or trigger mechanism 12. Mechanism 12 provides a controlled rate of fire or a single shot mode for the firearm or rifle 10. In other words, discrete independent actions other than the pulling of the trigger must occur between the firing of rounds from the firearm or rifle 10.

In this disclosure, a mechanical trigger mechanism 12 and a method for using such a mechanism to control the firearm 10 is disclosed. Embodiments of the invention may be applied to a wide variety of firearms or rifles, such as an AR-15, M4, M16 or U.S. Pat. No. 3,045,555 (Stoner) type. The contents of U.S. Pat. No. 3,045,555 are incorporated herein by reference thereto.

In various non-limiting embodiments the firearm or rifle may be anyone of gas operated, piston or hybrid, automatic or semi-automatic, non-limiting examples include the AR-15, M-4 or M-16 type or similar commercial variants thereof as well as other types of firearms or rifles described in above mentioned patents as well as U.S. Pat. No. 5,726,377, the entire contents of which are also incorporated herein by reference thereto.

Reference is made to the following U.S. Pat. Nos. 6,792,711; 7,131,228; and 7,775,150 the entire contents each of which are incorporated herein by reference thereto. Although the present invention will be described with reference to the embodiments shown in the drawings, it should be understood that the present invention can be embodied in many alternate forms of embodiments. In addition, any suitable size, shape or type of elements or materials could be used.

In one exemplary embodiment, the firearm or rifle 10 has an upper receiver 14 secured to a lower receiver 16 as is known in the related arts. The firearm or rifle 10 also has a mounting block or gas block 18 that is configured to be in fluid communication with a bore of a barrel 20 via an opening that is fluidly coupled to a complementary opening of the barrel such that a gas operating system for the firearm or rifle 10 can be provided. Non-limiting examples of such systems are described in the following U.S. Pat. Nos. 5,726,377; 5,945,626; 7,610,844; 7,934,447; and 7,938,055 the entire contents each of which are incorporated herein by reference thereto. Still further, reference is made to the following pending U.S. Patent Publication No. 2012/0152104 filed Sep. 14, 2009, the entire contents of which is incorporated herein by reference thereto. In addition the entire contents of the following PCT application WO 2010/030987 is also incorporated herein by reference thereto.

In a gas operated, piston or hybrid system, a bolt carrier or bolt carrier assembly 22 moves between a first position 24, wherein a firing pin 26 is positioned to be contacted by a hammer 28 of trigger mechanism 12 when hammer 28 is moved from a first position 30 to a second position or firing position 32 via actuation of a trigger 34. Operation of hammer 28 and trigger 34 is similar to that disclosed in U.S. Patent Publication No. US 2011/0079137 the entire contents of which are incorporated herein by reference thereto as well as any of the aforementioned patents and patent applications.

When the trigger 34 is pulled, the hammer 28 is released and moves to the second position or firing position 32 and engages the firing pin 26 to fire a round 27 from the firearm or rifle 10. In one embodiment, the hammer 28 is spring biased into the second position by a spring 29.

Once hammer 28 is in the second position 32, firing pin 26 is contacted and a round 27 is discharged from the barrel 20 of the firearm or rifle 10. During this operation, gases are discharged from barrel 20 into mounting block or gas block 18, wherein these gases are used to move the bolt carrier or bolt carrier assembly 22 rearwardly in the direction of arrow 36.

As is known in the related arts, this rearward movement of the bolt carrier assembly 22 in the direction of arrow 36 will cause the cartridge of the fired round to be extracted and expelled from the firearm or rifle 10. In addition, the rearward movement of the bolt carrier assembly 22 towards a second position causes the hammer 28 to be cocked or returned to its first position against the biasing force of spring 29, wherein the hammer 28 is caught and held in that position by the engagement of a sear of the hammer 28 with a sear of the trigger 34.

In addition, this rearward movement of the bolt carrier assembly 22 will also cause the compression of an operational spring or buffer spring 38 in the direction of arrow 36.

However, in accordance with various exemplary embodiments of the present invention, the trigger mechanism 12 is configured to prevent the movement of the bolt carrier assembly 22 back towards its first position 24 after firing of a round 27 and thus, a subsequent chambering of a round cannot occur until mechanism or trigger mechanism 12 is independently actuated. Thus, automatic or semi-automatic operation of the firearm or rifle 10 is not possible.

In accordance with one non-limiting exemplary embodiment, and in order to impede the movement of the bolt carrier assembly 22 back towards its first position 24 after the firing of a round 27, a release 40 is provided. In one embodiment, release 40 is configured to impede or block the movement of the bolt carrier assembly 22 back into its first position 24, unless a separate independent operator action is performed. Thus, trigger mechanism or mechanism 12 is specifically configured to prevent firearm or rifle 10 from operating as a "semiautomatic rifle" or automatic rifle. As used herein, one non-limiting definition for "semiautomatic rifle" is found in 35 U.S.C. §921, which states "any repeating rifle which utilizes a portion of the energy of a firing cartridge to extract the fired cartridge case and chamber the next round, and which requires a separate pull of the trigger to fire each cartridge". In one embodiment, the release 40 comprises a blocking member 42 movably mounted to the firearm or rifle 10 or the lower receiver 16 for movement between a first position or blocking position 44 and a second position or release position 46. In one non-limiting embodiment, blocking member is movably received within a slot 43 of the lower receiver 16.

In one embodiment, the blocking member 42 is pivotally mounted to the lower receiver 16 via a pin or other equivalent member 48. In addition, the blocking member 42 is spring biased into the first position 44 via a spring 50. Of course, numerous other equivalent configurations are contemplated. When the blocking member 42 is in the first position 44, a portion of the blocking member 42 will prevent the bolt carrier assembly 22 from moving back towards its first position 24 (e.g., preventing semi-automatic or automatic operation of the firearm or rifle 10).

Figure 2B:
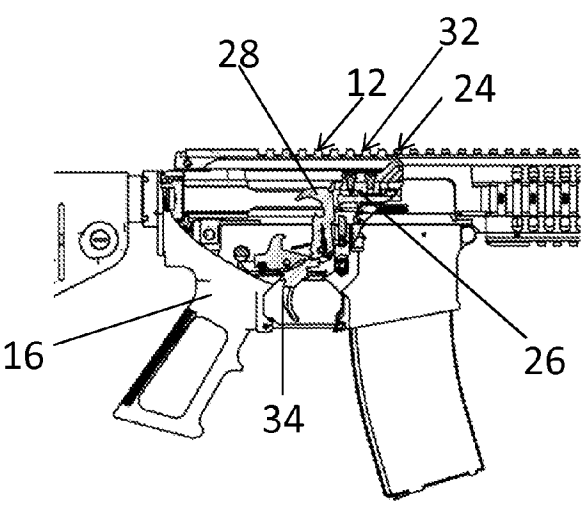
Figure 2A:
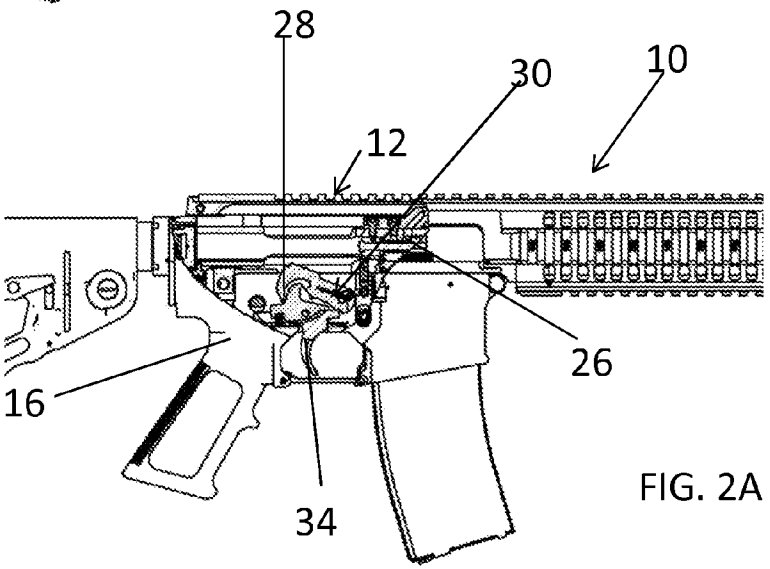
Figure 2:
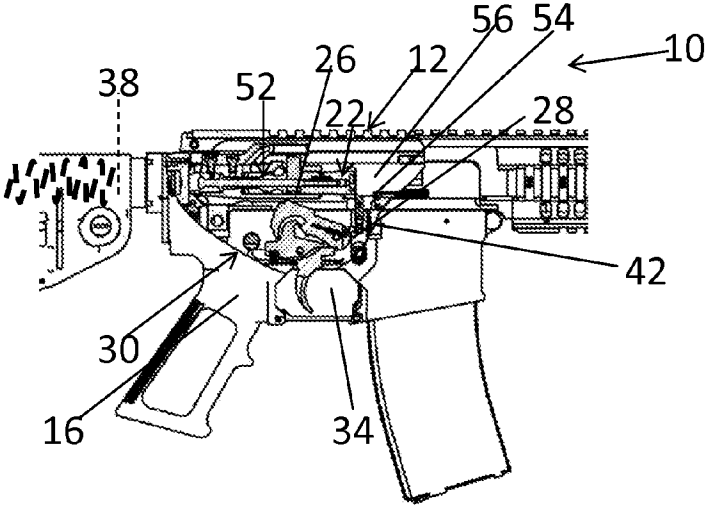
Figure 4A:
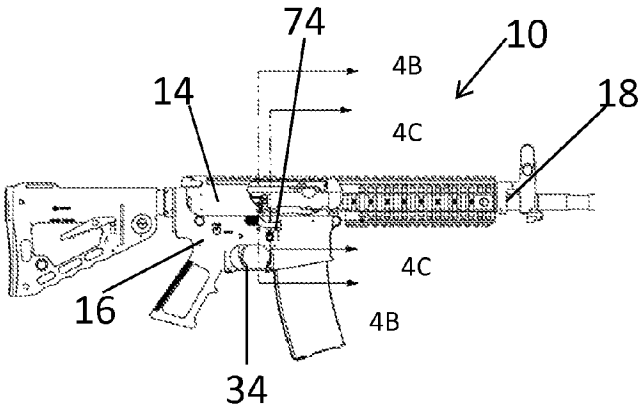
FIG. 4A is a partial cross-sectional view of the firearm illustrating operation of various embodiments of the present invention.
Figure 4B:
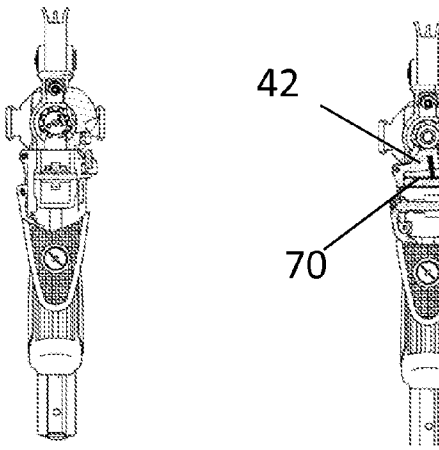
FIG. 4B is a view along lines 4B-4B of FIG. 4A.
Figure 4C:
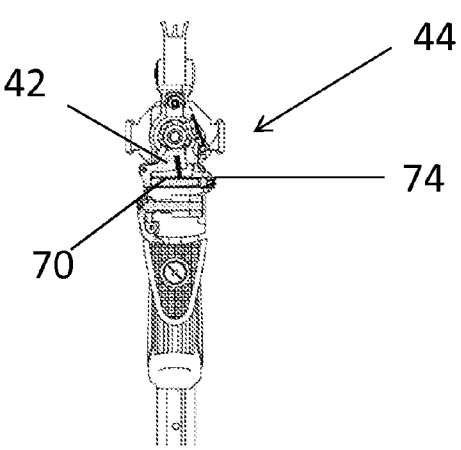
FIG. 4C is a view along lines 4C-4C of FIG. 4A.
Figure 5A:
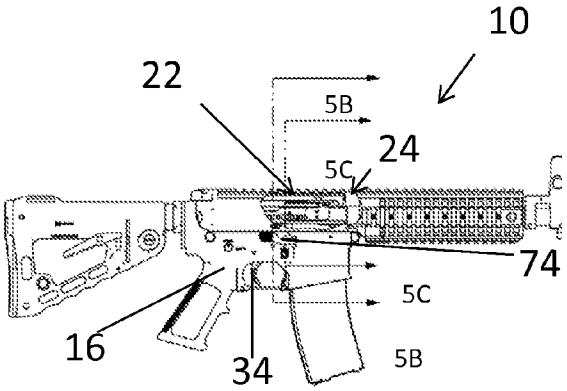
FIG. 5A is a partial cross-sectional view of the firearm illustrating operation of various embodiments of the present invention.
Figure 5B:
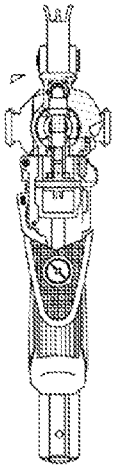
FIG. 5B is a view along lines 5B-5B of FIG. 5A.
Figure 5C:
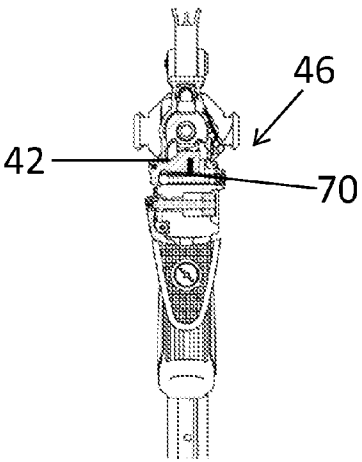
FIG. 5C is a view along lines 5C-5C of FIG. 5A.
Figure 6A:
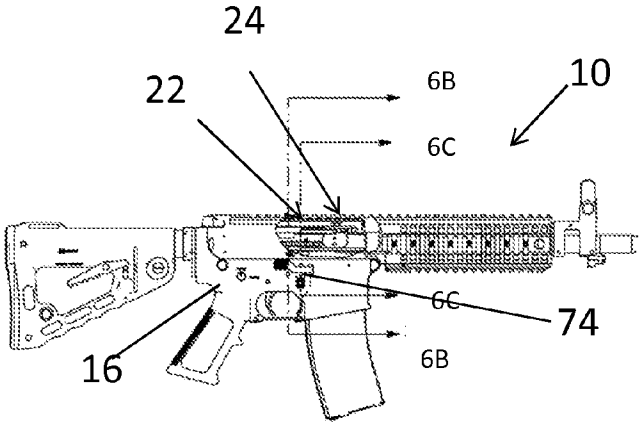
FIG. 6A is a partial cross-sectional view of the firearm illustrating operation of various embodiments of the present invention.
Figure 6B:
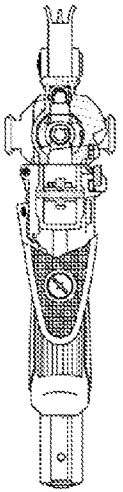
FIG. 6B is a view along lines 6B-6B of FIG. 6A.
Figure 6C:
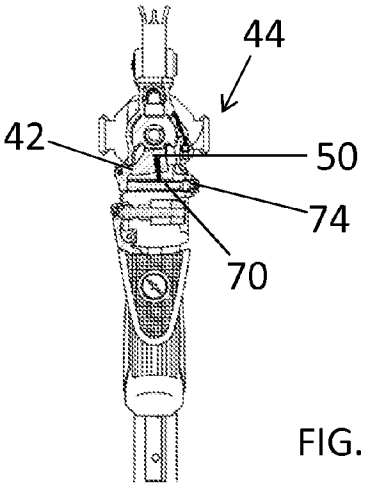
FIG. 6C is a view along lines 6C-6C of FIG. 6A.

This is illustrated in at least FIGS. 2 and 3, wherein the bolt carrier assembly 22 has been moved in the direction of arrow 36 to a rearward or second position 52 of the bolt carrier assembly 22. Once this occurs, the spring biasing force of spring 50 causes the blocking member 42 to pivot or move into its first position 44, wherein a portion of the blocking member 42 will contact a forward end 54 of the bolt carrier assembly 22 or a bolt 56 in the bolt carrier of the bolt carrier assembly 22.

In this position, spring 38 is compressed and provides an urging or biasing force in a direction opposite to arrow 36 such that once blocking member 42 is moved from its first position 44 to its second position 46, the bolt carrier assembly 22 is free to move into its forward position 24 in a direction opposite to arrow 36. This occurs because blocking member 42 no longer impedes the forward movement of the bolt carrier assembly 22 in the direction opposite to arrow 36 and accordingly, the compressed spring 38 is released.

In order to facilitate the movement of blocking member 42 from its first position 44 to its second position 46, an actuation member 58 is provided. In accordance with one non-limiting exemplary embodiment, actuation member 58 comprises a pin or rod 70 slidably or movably mounted to the lower receiver 16 for movement in the direction of arrows 72. In order to facilitate the movement of pin or rod 70 in the direction of arrow 72, a release button 74 is provided.

In one embodiment, the release button 74 is pivotally mounted to the lower receiver and operatively coupled to pin or rod 70 such that movement of the same causes a corresponding movement of pin or rod 70 in the direction of arrows 72. For example, pin or rod 70 can transition from a first position 73 to a second position 75 through actuation of release button 74. When this occurs, a distal end 77 of pin or rod 70 contacts an ear portion 79 of blocking member 42, thereby causing blocking member 42 to transition from its first position 44 to its second position 46.

Accordingly, actuation of release button 74 by an operator of the firearm or rifle 10 causes the blocking member 42 to transition from its first position 44 to its second non bolt carrier assembly blocking position 46. In other words and in order to transition the bolt carrier assembly 22 from its second position 52 into its first position 24 an operator must actuate release button 74. Moreover and as described herein, various exemplary embodiments require independent actuation of the release button (e.g., pushing and releasing) otherwise subsequent operation of the trigger 34 will be ineffective for firing a round.

As illustrated, release button 74 is located proximate to trigger 34 such that an operator can actuate release button 74 with one of their fingers allowing the bolt carrier assembly 22 to move into its first position 24. At this point, an operator of the firearm or rifle can then pull the trigger and cause hammer 28 to move into its second position or firing position 32 that will cause the same to contact firing pin 26 and thus fire a round from the firearm or rifle 10. However and in accordance with an exemplary embodiment of the present invention, release 40 must first be actuated before a subsequent action (e.g., pulling of the trigger 34) can occur, which causes the round 27 to be fired from the firearm or rifle 10.

Thereafter and as discussed above, the released gases from the round 27 will cause the bolt carrier assembly 22 to move rearwardly in the direction of arrow 36. As the bolt carrier assembly 22 moves in the direction of arrow 36, blocking member 42 will ultimately move back into its first position 44 from its second position 46 as the bolt carrier or bolt carrier assembly 22 moves rearward in the direction of arrow 36 and will no longer contact blocking member 42. It being understood, that the trigger mechanism 12 is configured so that blocking member 42 moves into its first position 44 once the bolt carrier assembly 22 no longer makes contact due to its rearward movement.

Once the bolt carrier assembly 22 reaches its second position 52, the spring biasing force of spring 50 causes the blocking member 42 to transition from its second position 46 back into its first position 44, so that contact can be made with forward portion 54 of bolt carrier assembly 22 or alternatively, a bolt 56 received within the bolt carrier of the bolt carrier assembly 22 as the bolt carrier assembly stops its rearward movement and begins to move forward in a direction opposite to arrow 36 due to spring 38. It being understood that movement of the bolt carrier assembly 22 in the direction of arrow 36 is sufficient enough to cause the forward portion 56 to travel past blocking member 42 so that it can be urged into its first position 44. Thereafter, bolt carrier assembly 22 will begin its movement in a direction opposite to arrow 36 until forward portion 54 contacts blocking member 42 and thus, the bolt carrier assembly 22 is retained in its second position 52. Accordingly, a round cannot be chambered by the bolt carrier assembly 22 until the blocking member 42 is moved from its first position 44 to its second position 46 through an independent user action that causes movement of release 40.

When the bolt carrier assembly 22 is in its second position 52 hammer 28 cannot contact the firing pin 26 and thus, the firearm or rifle 10 cannot be fired. Still further and when the bolt carrier assembly 22 is in its second position 52 a round is not chambered since the bolt carrier assembly 22 has not moved to its first position 24. Accordingly and for an operator to fire another round, blocking member 42 must be moved from its first position 44 into its second position 46. At this point, movement of the blocking member 42 must be facilitated by independent movement of release button 74. Once this occurs, the bolt carrier assembly 22 will move forward back into its first position 24, wherein a round is chambered and actuation of trigger 34 will cause hammer 28 to contact firing pin 26 and thus fire the round from the firearm or rifle 10.

Figures 7, 7A, 7B, 7C, 7D, 7E:
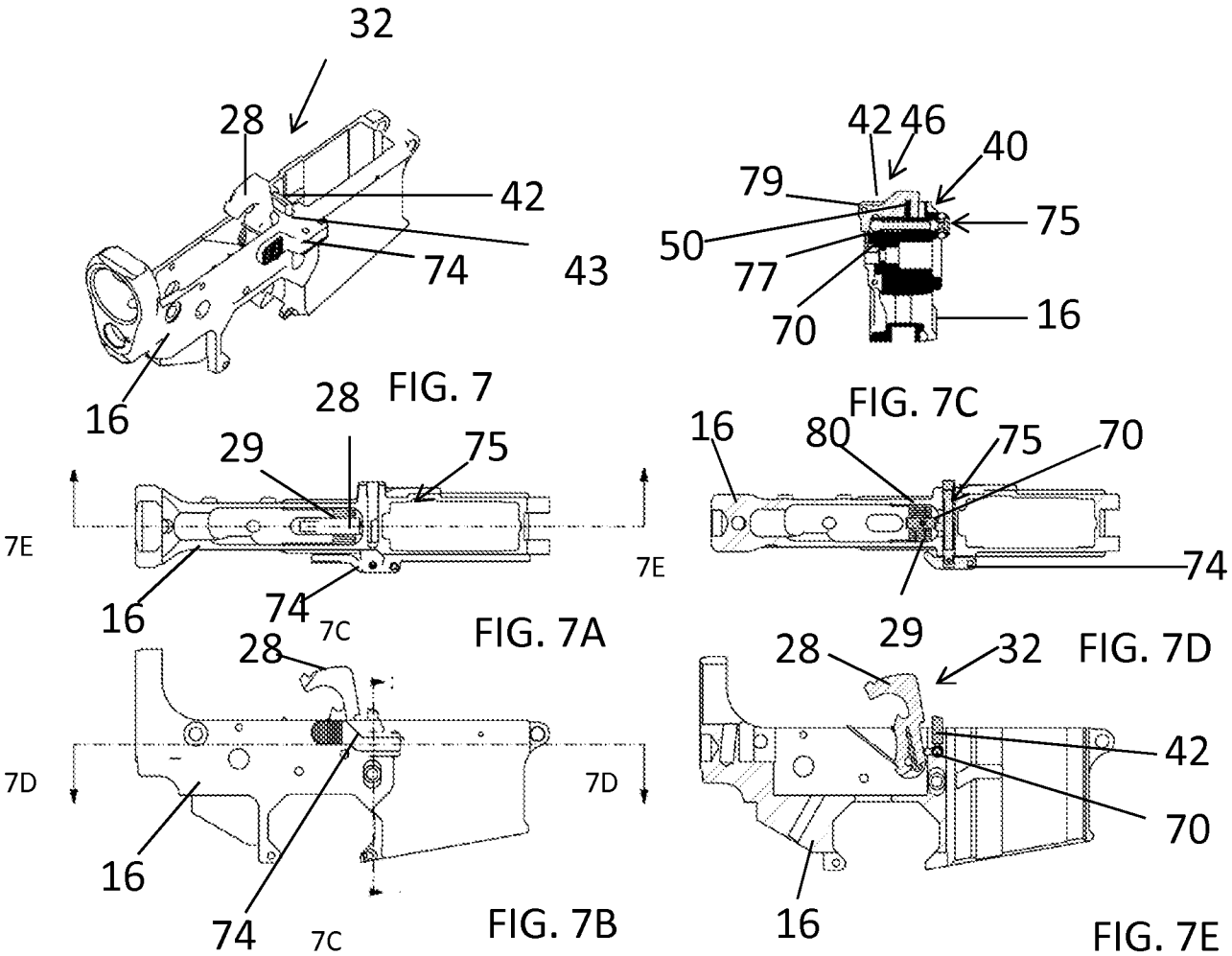
FIG. 7 is a perspective view of portions of a firearm illustrating operation of various embodiments of the present invention.
FIG. 7A is a top view of FIG. 7.
FIG. 7B is a side view of FIG. 7.
FIG. 7C is a view along lines 7C-7C of FIG. 7B.
FIG. 7D is a view along lines 7D-7D of FIG. 7B.
FIG. 7E is a view along lines 7E-7E of FIG. 7A.
Figure 8:
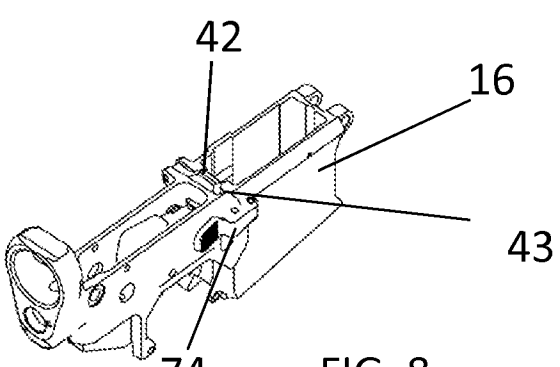
FIG. 8 is a perspective view of portions of a firearm illustrating operation of various embodiments of the present invention.
Figure 8C:
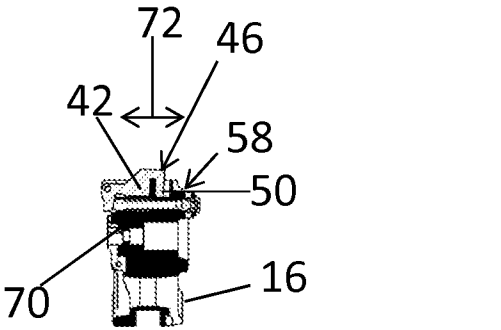
FIG. 8C is a view along lines 8C-8C of FIG. 8B.
Figure 8A:
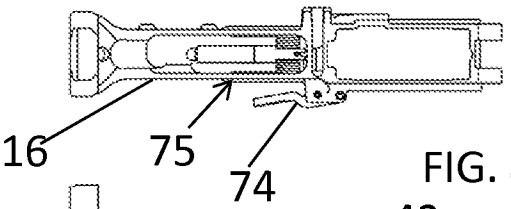
FIG. 8A is a top view of FIG. 8.
Figure 8D:
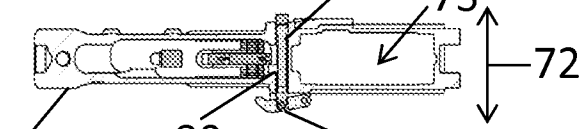
FIG. 8D is a view along lines 8D-8D of FIG. 8B.
Figure 8B:
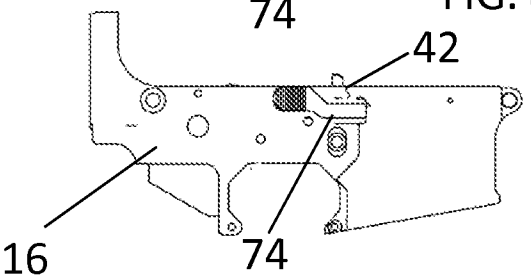
FIG. 8B is a side view of FIG. 8.
Figure 8E:
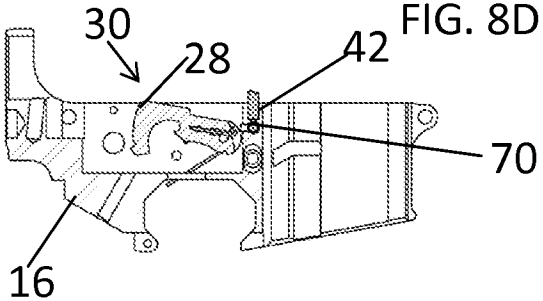
FIG. 8E is a view along lines 8E-8E of FIG. 8A.
Figures 9, 9A, 9B, 9C, 9D, 9E:
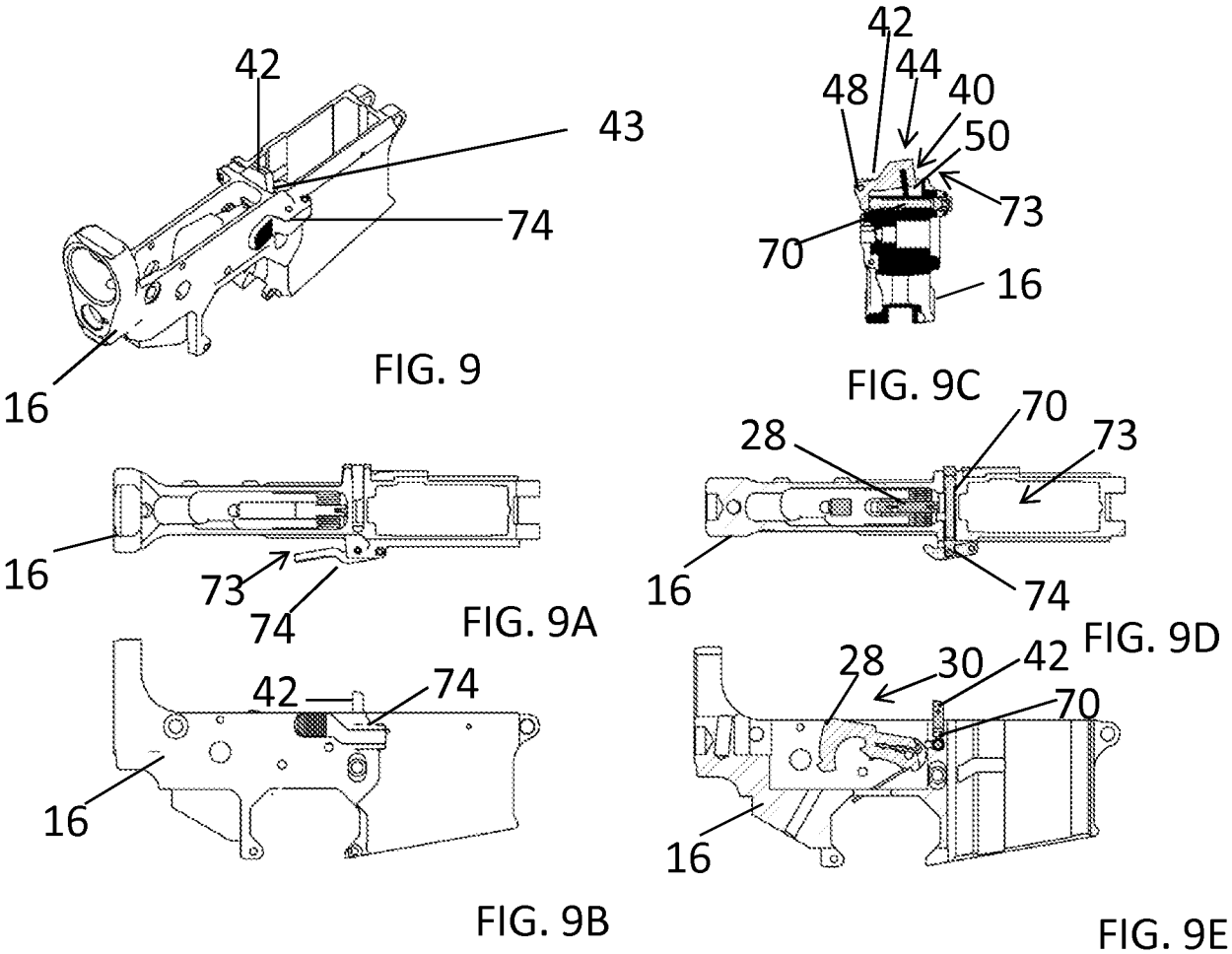
FIG. 9 is a perspective view of portions of a firearm illustrating operation of various embodiments of the present invention.
FIG. 9A is a top view of FIG. 9.
FIG. 9B is a side view of FIG. 9.
FIG. 9C is a view along lines 9C-9C of FIG. 9B.
FIG. 9D is a view along lines 9D-9D of FIG. 9B.
FIG. 9E is a view along lines 9E-9E of FIG. 9A.

Referring now to at least FIGS. 7D, 8D and 9D and in one non-limiting embodiment, pin or rod 70 is configured to have a protrusion or feature 80 which extends outwardly away from pin rod 70. Protrusion or feature 80 is configured to make contact with or inhibit movement of hammer 28 from its first position 30 to its second position 32, when pin or rod is in its second position 75. In other words, protrusion 80 is configured to inhibit operation of the hammer 28, should release button 74 be held in its actuated position after the firing of a round 27 from the firearm or rifle 10 in an attempt to cycle the bolt carrier assembly 22 from its first position 24, to its second position 52 and back to its first position 24 without it being held in the second position 52 by the blocking member 42. Although, a specific configuration for protrusion or feature 80 is illustrated in the attached FIGS. it is, of course, understood that various configurations and equivalent mechanisms or means may be employed to provide to inhibit the contact of hammer 28 with the firing pin 26 should release button 74 not be independently actuated to in an attempt to provide semi-automatic or automatic operation of the firearm or rifle 10.

Although specific embodiments depicting a trigger mechanism 12 for a firearm or rifle 10 are described with reference to the embodiments shown in the drawings, it should be understood that the present invention can be embodied in many alternate forms of embodiments.

Figure 10:
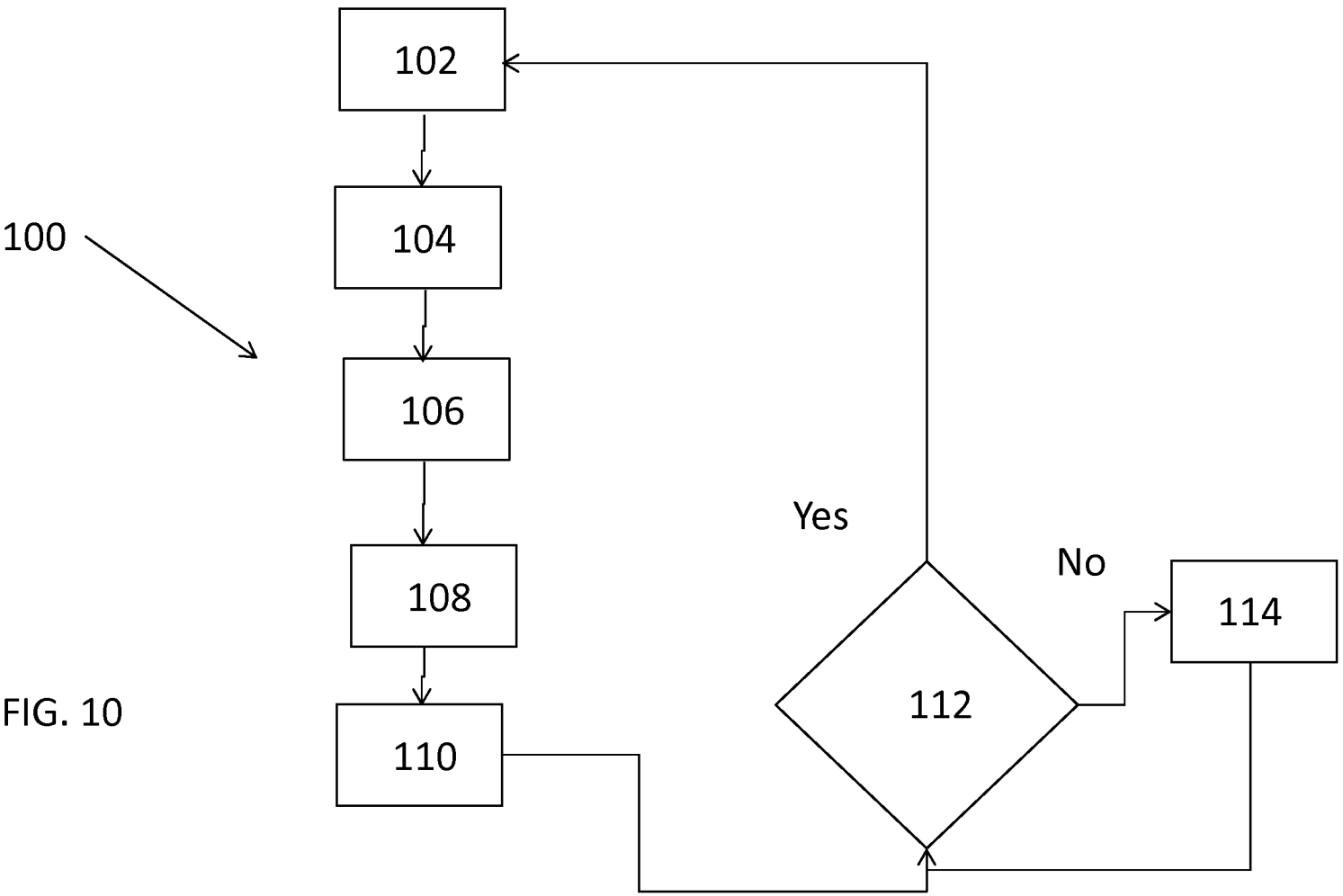
FIG. 10 schematically illustrates a method and/or apparatus of controlling the firing rate or a method and/or apparatus of firing a round from a firearm in accordance with various embodiments of the present invention.

FIG. 10 schematically illustrates a method and/or apparatus of controlling the firing rate or a method and/or apparatus 100 of firing a round from a firearm or rifle 10 in accordance with various embodiments of the present invention. At step 102, a bolt carrier assembly 22 is advanced to its first position 24, wherein actuation of a trigger 34 will cause a hammer 28 to contact a firing pin 26 of the bolt carrier assembly 22 (as mentioned above, this movement chambers a round for firing from the rifle) and thus fire a round 27 from the firearm or rifle 10. Actuation of the trigger 34 and firing of the round 27 is illustrated at box 104. Thereafter and at step 106, the bolt carrier assembly 22 is driven rearwardly back towards a second position 52, wherein a spring 38 is compressed. Afterwards and at step 108, the bolt carrier assembly 22 is retained at its second position 52 via engagement of the same with a portion of a release 40. At this point, release 40 must be actuated so that the bolt carrier assembly 22 can transition from its second position 52 to its first position 24 (step 110) in order to chamber another round.

Actuation of the release 40 of trigger mechanism 12 is illustrated by node 112. Here actuation button 74 of release 40 of trigger mechanism 12 must be released (e.g., independent actuation) (indicated by yes) otherwise the firing of the round (step 104) will not occur (indicated by no) and hammer 28 will not contact firing pin 26 (step 114).

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A trigger mechanism for a firearm, the trigger mechanism comprising:

a trigger operatively coupled to a hammer of the trigger mechanism, wherein actuation of the trigger advances the hammer to a firing position; and a release comprising a blocking member movably mounted to a lower receiver of the firearm for movement between a first position and a second position, wherein a portion of the blocking member impedes movement of a bolt carrier assembly when the blocking member is in the first position and wherein the blocking member does not impede movement of the bolt carrier assembly when the blocking member is in the second position, wherein the blocking member is biased into the first position and wherein the blocking member must be first moved from the first position to the second position and thereafter from the second position to the first position in order for the hammer to advance to the firing position after actuation of the trigger.

2. The trigger mechanism as in claim 1, wherein the blocking member is spring biased into the first position.

3. The trigger mechanism as in claim 1, wherein the blocking member is pivotally mounted to the lower receiver.

4. The trigger mechanism as in claim 1, wherein the blocking member is operatively coupled to an actuation member movably mounted to the lower receiver such that movement of the actuation member moves the blocking member between the first position and the second position.

5. The trigger mechanism as in claim 4, wherein the actuation member is slidably mounted to the lower receiver and is operatively coupled to a release button pivotally mounted to the lower receiver.

6. The trigger mechanism as in claim 1, wherein the blocking member is moved between the first position and the second position by an actuation member operatively coupled to the blocking member such that movement of the actuation member from a first position to a second position by a release button operatively coupled to the actuation member moves the blocking member between the first position and the second position, wherein the release button is movably mounted to the lower receiver, and wherein the actuation member is impedes movement of the hammer to the firing position when the actuation member is in the second position.

7. The trigger mechanism as in claim 6, wherein the actuation member allows movement of the hammer to the firing position when the actuation member is in the first position.

8. The trigger mechanism as in claim 6, wherein the actuation member has a protrusion that impedes movement of the hammer to the firing position when actuation member is in the second position.

9. The trigger mechanism as in claim 8, wherein the protrusion does not impede movement of the hammer to the firing position when the actuation member is in the first position.

10. A firearm, comprising:

a barrel;

a bolt carrier assembly movably received within the firearm for movement between a first position and a second position;

a trigger mechanism for firing a round from the firearm, the trigger mechanism comprising:

a trigger;

a hammer pivotally mounted to the firearm for movement between a first position and a second position, wherein actuation of the trigger causes the hammer to advance from the first position to the second position, wherein the hammer contacts a firing pin of the firearm;

a release comprising a blocking member movably mounted to a lower receiver of the firearm for movement between a first position and a second position, wherein a portion of the blocking member impedes movement of a bolt carrier assembly when the blocking member is in the first position and wherein the blocking member does not impede movement of the bolt carrier assembly when the blocking member is in the second position, wherein the blocking member is biased into the first position and wherein the blocking member must be first moved from the first position to the second position and thereafter from the second position to the first position in order for the hammer to advance to the second position after a round has been fired from the firearm.

11. The firearm as in claim 10, wherein the blocking member is spring biased into the first position.

12. The firearm as in claim 10, wherein the blocking member is pivotally mounted to the lower receiver.

13. The firearm as in claim 10, further comprising an actuation member movably mounted to the lower receiver and operatively coupled to the blocking member for moving the blocking member between the first position and the second position.

14. The firearm as in claim 13, wherein the actuation member is slidably mounted to the lower receiver and is actuated by a release button pivotally mounted to the lower receiver.

15. The firearm as in claim 10, wherein the blocking member is moved between the first position and the second position by an actuation member operatively coupled to the blocking member and wherein the actuation member is movably mounted to the lower receiver for movement between first position and a second position by a release button operatively coupled to the actuation member and wherein the release button is mounted to the lower receiver, wherein the actuation member impedes movement of the hammer to the second position when the actuation member is in the second position.

16. The firearm as in claim 15, wherein the actuation member allows movement of the hammer to the firing position when the actuation member is in the first position.

17. The firearm as in claim 15, wherein the actuation member has a protrusion that impedes movement of the hammer to the firing position when actuation member is in the second position, wherein the protrusion does not impede movement of the hammer to the firing position when the actuation member is in the first position.

18. A method of controlling the firing rate of a firearm, comprising:

limiting movement of a bolt carrier assembly of the firearm to a position such that a trigger of the firearm cannot fire another round from the firearm after a first round has been fired from the firearm; and releasing the bolt carrier assembly from the position to another position, wherein actuation of the trigger causes a hammer to contact a firing pin of the bolt carrier assembly, wherein the releasing of the bolt carrier assembly from the position is achieved by actuation of a release button located on a surface of the firearm proximate to the trigger, wherein the release button is operatively coupled to a blocking member movably mounted to a lower receiver of the firearm for movement between a first position and a second position, wherein a portion of the blocking member impedes movement of the bolt carrier assembly when the blocking member is in the first position and wherein the blocking member does not impede movement of the bolt carrier assembly when the blocking member is in the second position, wherein the blocking member is biased into the first position and wherein blocking member is moved to the second position via actuation of the release button.

* * * * *